United States Patent [19]

Thompson

[11] Patent Number: 4,557,064

[45] Date of Patent: Dec. 10, 1985

[54] FEATURED PRICE CARD HOLDER

[76] Inventor: James O. Thompson, 50 Graydon Hall Dr., Apt. 1109, Don Mills Ontario M3A 3A4, Canada

[21] Appl. No.: 662,791

[22] Filed: Oct. 16, 1984

Related U.S. Application Data

[63] Continuation of Ser. No. 498,540, May 26, 1983, abandoned.

[51] Int. Cl.[4] ..... G09F 3/18

[52] U.S. Cl. ..... 40/10 R; 40/361; 40/617; 40/11 R

[58] Field of Search ..... 40/10, 11, 617

[56] References Cited

U.S. PATENT DOCUMENTS

| | | | |
|---|---|---|---|
| 2,530,821 | 11/1950 | Hubbell | 40/10 R |
| 2,603,357 | 5/1952 | Zakos | 40/11 R |
| 3,325,929 | 6/1967 | Mauchline | 40/11 R |
| 3,530,605 | 9/1970 | Gutterson | 40/11 R |
| 3,787,922 | 1/1974 | Foy et al. | 248/473 |
| 4,258,493 | 3/1981 | Kettlestrings | 40/617 |

FOREIGN PATENT DOCUMENTS

| | | | |
|---|---|---|---|
| 2784 | 8/1932 | Australia | 40/617 |

*Primary Examiner*—Gene Mancene
*Assistant Examiner*—Wenceslao J. Contreras
*Attorney, Agent, or Firm*—Sim & McBurney

[57] ABSTRACT

A plastic display card holder for receiving and gripping a card for display purposes comprises interconnected spaced-apart parallel wall portions. The wall portions are connected in a manner to provide an entrance for insertion of a display card. A plurality of resilient plastic projections are provided on the holder which flex as the display card is inserted into the holder through the entrance. The flexed projections grip the inserted display card as the resilient projections attempt to recover to their normal unflexed position.

1 Claim, 14 Drawing Figures

FIG. 1.
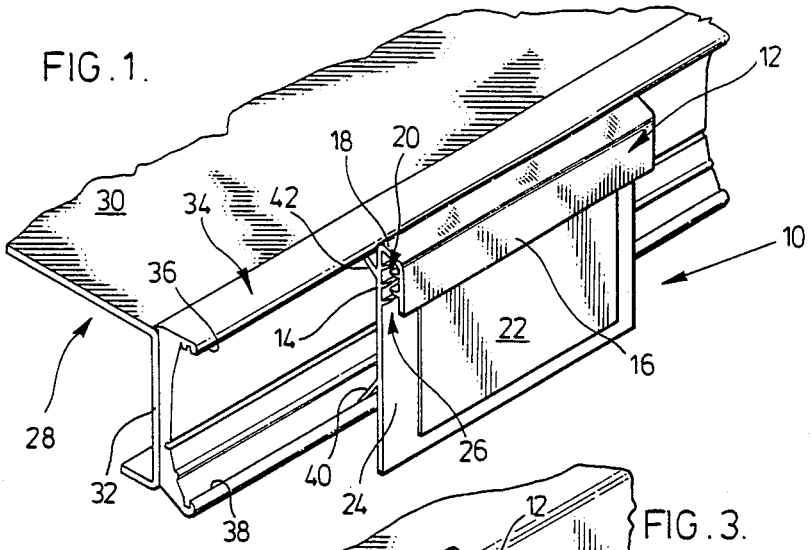
FIG. 3.
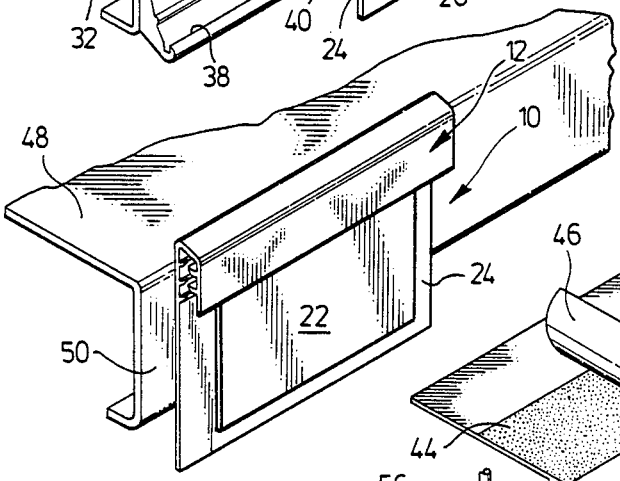
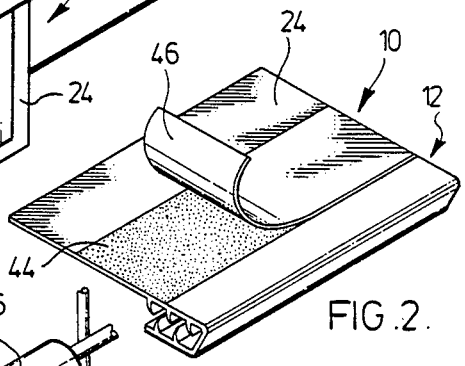
FIG. 2.
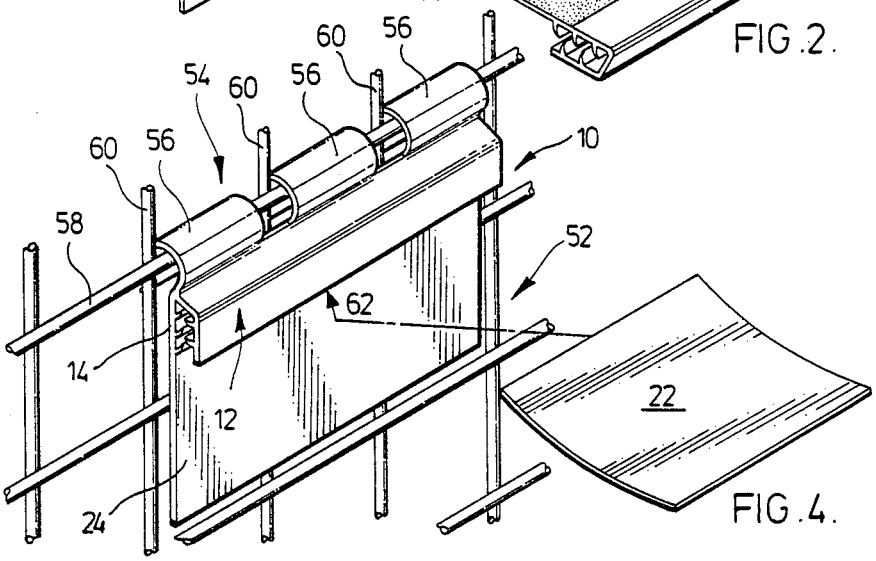
FIG. 4.

FEATURED PRICE CARD HOLDER

This application is a continuation of Ser. No. 498,540, filed May 26, 1983, and which is now abandoned.

FIELD OF THE INVENTION

This invention relates to plastic display card holders which are used in association with consumer items and the like for purposes of featuring the items.

BACKGROUND OF THE INVENTION

Interchangable display cards are often used to feature special information on consumer commodities in grocery stores, hardware stores and general merchandizing stores. It is important to have interchangability for the cards, since the feature may change and holders for the display cards may be moved from one item to another. Card holders commonly used are made of metal in the form of a clip which will receive the card for display. Unfortunately, the metal clips rust and corrode and become unattractive in featuring an item. In addition, metal clips, if abused or bent, loose their ability to hold the display card effectively. In addition, metal clips which are of the reusable, durable variety are relatively expensive to manufacture. In a store many various types of display units are used, so that an assorted inventory of many expensive metal clips is required.

SUMMARY OF THE INVENTION

The plastic display card holder, according to this invention, provides a durable, reusable clip for display cards which is readily manufactured in an inexpensive manner with facility to provide various forms of devices for connecting the holders to store items associated with the display.

According to an aspect of the invention, the plastic display card holder for receiving and gripping a card for display purposes comprises interconnected spaced-apart parallel wall portions. The wall portions are connected in a manner to provide an entrance for insertion of a display card. A plurality of flexible resilient plastic fins are integral with each wall portion and extends into the space between the wall portions. The fins flex as a display card is inserted into the holder through the entrance. The flexed fins grip an inserted display card as the fins attempt to recover to their normal unflexed position.

According to another aspect of the invention, the plastic display card holder may comprise an extruded hard plastic channel portion having opposing sidewalls with a plurality of soft plastic fins coextruded on each sidewall and projecting into the space between the sidewalls. The soft plastic fins, as they extend the length of the corresponding sidewall, project into the space between the sidewalls in a manner to be flexed when a display card is inserted into the channel. Such flexed fins frictionally engage and grip the inserted display card to hold it in place.

According to another asepect of the invention, the fins may be provided on the holder in a manner such that they increase their grip on the inserted display card when it is attempted to withdraw the display card from the holder.

BRIEF DESCRIPTION OF THE DRAWINGS

Preferred embodiments of the invention are shown in the drawings wherein:

FIG. 1 is a perspective view of a preferred embodiment of the display card holder;

FIG. 2 is a perspective view of an alternative embodiment for the display card holder;

FIG. 3 is a perspective view of the display card holder of FIG. 2 as adhesively secured to shelving for supporting items on display;

FIG. 4 is a perspective view showing an alternative embodiment for the display card holder;

DETAILED DESCRIPTION OF THE PREFERRED EMBODIMENTS

Figure 5:
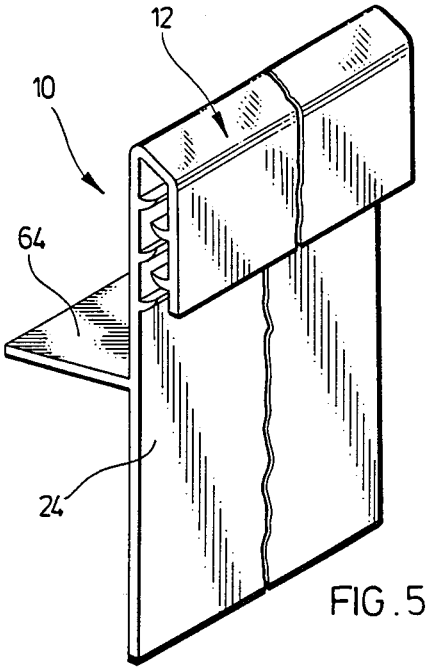
FIG. 5 is a perspective view of another alternative embodiment of the display card holder.

It is appreciated that display card holders may be used in many ways, some of which are exemplified in the drawings. Display card holders can be used to hold cards which advertise a feature on a particular item for sale or in the more standard way of simply advertising the item price. According to the embodiment of FIG. 1, the feature card holder 10 has a U-shaped channel portion 12 which has a rear wall 14 and front wall 16 interconnected to one another by the transverse wall 18 of the U-shaped channel. Projections 20 are associated with the inside of the front and rear walls to receive and grip a display card 22. The rear wall 14 of the channel 12 has an integral depending support portion 24. The support 24 in conjunction with the front wall 16 define an entrance 26 into the channel 12. The height of the support 24 provides an initial guide in inserting a card 22 into the holder where the inside surface of the front wall also assists to guide the insertion of the card into the projections 20. The rear wall 14 with integral support portion 24 provides, according to this embodiment, the means by which elements are connected to the holder to connect it to store shelving or the like to feature the items on the shelf.

As shown in FIG. 1, a shelving unit 28 has shelf portion 30 with depending front wall 32. Secured to the front wall 32 is a metal extrusion 34 which has opposing lip portions 36 and 38. Extrusion 34 is commonly found in most supermarkets to enable the location of price tags and the like. The feature card holder 10 has provided on its rear face outwardly extending ledges 40 and 42 which may be slightly flexed in the manner to be discussed with respect to FIG. 10 for placement into the extrusion 34, so that the display card 22 may be prominently located for featuring the items on the shelf 30.

The holder 10 is formed from a plastics material, where the projections 20 within the channel are coextruded onto the interior faces of the rear and front walls 14 and 16. The holder 10 may have its channel portion and depending support portion extruded from a relatively hard rigid plastic, whereas the projections 20, which flex to receive and grip the display card, are coextruded from pliable resilient plastics. Suitable materials for the holder rigid plastic portion are rigid polyvinylchloride and rigid acetates. For the more flexible projections, they are coextruded of flexible polyvinylchloride on the rigid polyvinylchloride, or flexible ethylenevinylacetate on the rigid acetate.

It is appreciated that many other forms of plastics may be used, as will be readily apparent to those skilled in the art. The durometer ratings of such hard and soft plastics are such that the hard plastic provides sufficient rigidity in the channel 12 that the opposing walls undergo minimal spreading or opening up when the card is inserted or withdrawn from the holder. The hard plastic is essentially rigid. As to the projections 20, they are sufficiently pliable to receive the display card when pushed into the channel portion 12. Normally display cards are made of reasonably stiff cardboard material, so that when pushed edgewise into the channel, they have fairly high structural strength so as to flex the projections 20. It has been found that the durometer rating for the plastic of the projections may be in the range of 55 to 95.

Before discussing in detail the manner in which the projections in the channel grip the display card, reference is made to other arrangements for the holder to accommodate various uses with the display. An advantage of making the holders by extrusion is that many different shapes may economically be made to accommodate such variations in uses. As shown in FIG. 2, the holder 10 with channel portion 12 and support wall 24 has applied to its rear face a pressure-sensitive adhesive 44 as covered by silicon treated release paper 46. This facilitates application of the feature card holder 10 to areas which are not provided with devices to which the holder may be connected. For example, the shelving 48 has depending front wall 50 with no provision for connection thereto. The holder 10, having the pressure-sensitive adhesive backing 44 with the release paper 46 removed, may be applied to the front wall 50 and stuck thereon to hold the display card 22 against the rear support 24.

In the area of bulk item marketing, wire baskets 52 are commonly used to hold goods in the manner shown in FIG. 4. To connect a display card holder to the basket, the holder 10 has extending upwardly from the rear wall 14 of the channel 12 a plurality of clips 54. Each clip member 56 is clipped over the wire strand 58 of the basket between the vertical wires 60. The support wall 24 rests against the horizontal and vertical wires to support the holder and permit insertion of a display card 22 in the direction of arrow 62.

Figure 12:
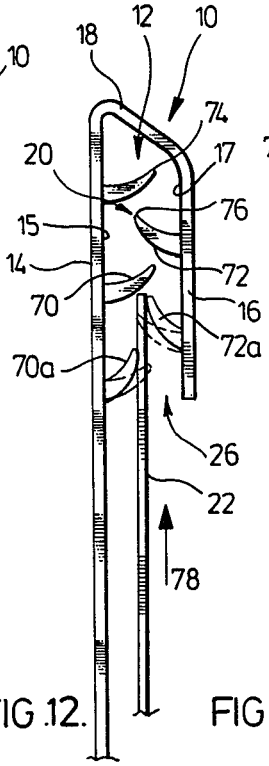
FIGS. 12 through 14 show in sequence the insertion and withdrawal of a display card.

In other instances where no containers or shelves are used to hold the goods to be sold, another adaptation, as shown in FIG. 5, is provided for the display card holder 10. An integrally formed rearwardly extending ledge 64 is formed on support 24. As shown in FIG. 12 with boxes of goods to be sold, the ledge portion 64 is located between upper and lower boxes 66 and 68 of the goods to fix the display card holder 10 relative to the goods to be featured. The display card can then be inserted into the projections 20 in the manner to be discussed with regard to FIGS. 13 through 15.

It is apparent that, in a standard store operation, many varieties of featured card holder shapes must be provided so as to be useful on shelves, baskets, boxed displays and the like. By virtue of extruding the display card holders from a plastics material, the variety of shapes are readily formed in an economical manner to provide a durable unit for repeated uses.

Figure 11:
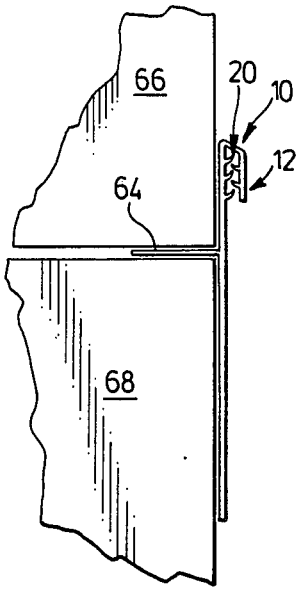
FIG. 11 is a side elevation of the display card holder of FIG. 5 shown in position.
Figure 10:
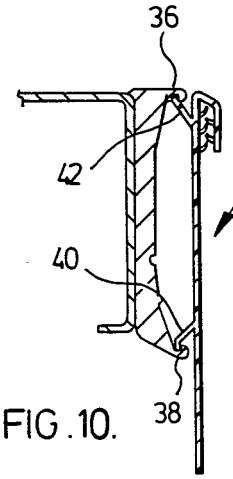
FIG. 10 is a side elevation of the display card holder of FIG. 9 in position.

Referring to FIG. 10, the display shelf arrangement 28 with shelf 30 and depending front wall 32 has the standard price tag extrusion 34 provided with the opposing lips 36 and 38. The rear support wall 24 is of a plastic, although it is rigid, will permit some flexing. By squeezing the edges in the manner shown in FIG. 10, the support wall 24 can be bowed slightly to move the ledges 40 and 42 slightly towards one another to fit between the opposing ledges 36 and 38. On release of the pressure on the upper and lower portions of the display card holder, the plastics wall 24 recovers to its original planar position. As shown in FIG. 11, the ledges 40 and 42 are snugly received by opposing ledges 36 and 38 to hold the display card holder 10 in position.

Figure 13:
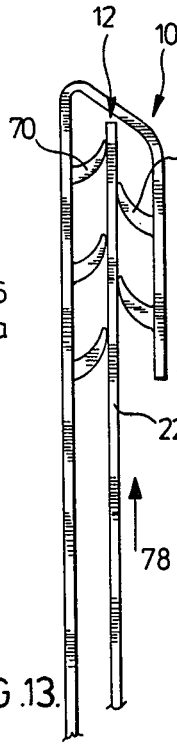
Figure 14:
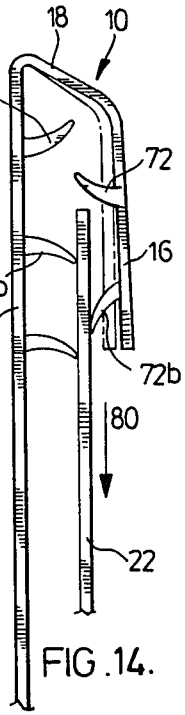

Turning to FIG. 13, the section of the display card holder 10 shows the channel portion 12 with rear wall 14, front wall 16 and interconnecting web portion 18. According to this embodiment, the interconnecting portion 18 slopes downwardly to provide a more pleasing appearance for the display card holder 10 and to allow any dust and the like to roll off of the upper ledge 18. The rows of projections 20, provided in the channel 12, are coextruded onto the interior surfaces 15 and 17 of the rear and front walls. By virtue of coextruding the projections 20 onto the wall portions, they extend the width of the respective rear and front walls. The material for the projections 20 is as discussed much softer than the rigid plastic used for the channel portion. According to this preferred embodiment, on the rear wall there are three rows of projections 70 and two rows of projections 72 on the front wall. Each set of projections extend into the space between the front and rear walls, where the projections as they opposed one another are offset vertically. The extremities 74 and 76 of the opposing projections overlap to the extent shown. The cross-section of the projections are somewhat fin-shaped, where the projections are slanted away from the entrance 26. Due to the soft, flexible nature of the projecting fins 70 and 72, they flex upwardly as shown at **70*a* and 72*a* to receive the display card 22 as inserted in the direction of arrow 78. It should be noted that there is minimal if any outward flexing of the front wall 16 away from the rear wall 14. Insertion of the display card 22 is continued as shown in FIG. 14 until the display card has passed the uppermost fin 70 in the channel area 12. At this point, all of the fins 70 and 72 are flexed upwardly away from their normal resting position. Due to the inherent resiliency of the soft plastic material, the projections 70 and 72 attempt to return to their normal position. In so doing, they frictionally engage and grip the display card 22. This prevents the display card falling out of the holder 10** as would be caused by gravity, drafts and the like acting on the display card.

In the event that the display card 22 is to be removed from the holder 10 in the direction of arrow 80, the display card 22 is gripped and pulled downwardly. Due to the rigid structure of the rear and front walls 14 and 16 as interconnected by traversing portion 18, there is minimal spreading of the front wall relative to the rear wall when the display card 22 is withdrawn. The flexible projections 70 and 72, as they frictionally engage the display card, must be flexed downwardly in the direction of arrow 80 as the card is withdrawn. Because the front wall 16 will spread slightly if at all relative to the rear wall, in order for the card to be withdrawn the fins 70 and 72 must become considerably distorted as the card is withdrawn until the fins 70 and 72 invert downwardly to the position shown at **70*b* and 72*b*. This inverting action by the fins increases their grip on the display card as one attempts to withdraw the display card 22. Once the fins have gone through considerable distortion and have flipped over to their inverted positions of 70***b* and 72*b*, the gripping action is reduced. Thus with this arrangement for the fins, one is able to readily insert the card into the holder, yet encounters resistance to withdrawal. This ensures that consumers when picking up items should they accidentally bump into the display card 22, it is not readily flipped from the holder. However, the fins are sufficiently flexible so as that one can intentionally withdraw the display card 22 without ripping it.

Due to the flexible nature of the fins, the holder may be reused several times for holding display cards. The fins, as they are contained within the channel 12, are protected from sharp objects and the like cutting and removing them from the channel. In addition, their softness and pliability is also useful in gripping cards with glossy finishes to ensure that they are held within the holder 10. The offset nature for the fins 70 and 72 allows this overlap of the fin extremities to provide the needed grip on the card, yet facilitate its insertion because the card edge as inserted into the channel does not encounter two opposing fins at any one time. It is appreciated, however, in instances where sufficiently stiff cards are used, fins which directly oppose one another may be used.

Figure 6:
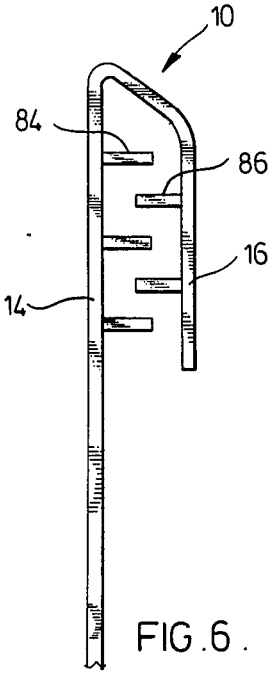
FIGS. 6 through 8 are sectional views of the display card holder showing various alternatives for the flexible gripping projections in the holder.
Figure 7:
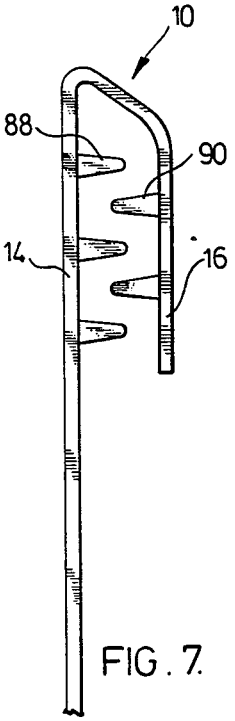
Figure 8:
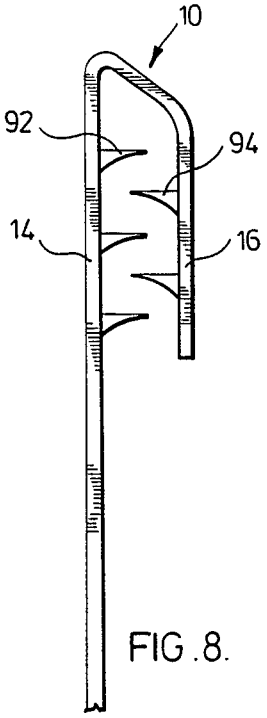
Figure 9:
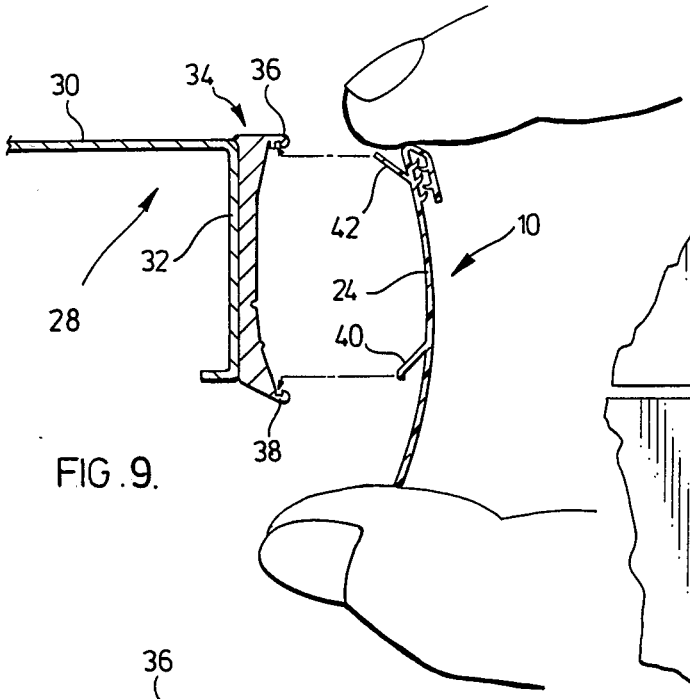
FIG. 9 is the side elevation showing the insertion of the display card holder of FIG. 1 into a support shelf for displayed items.

It is appreciated that several arrangements and shapes may be used for the projections within the channels of a display card holder. For example, in FIG. 6, the display card holder 10 has rectangular-shaped fins 84 and 86 coextruded on the rear and front walls 14 and 16. With the holder 10 of FIG. 7, oval-shaped fins or projections 88 and 90 are coextruded on the rear and front walls 14 and 16. With FIG. 8, barb-shaped projections 92 and 94 are coextruded on the rear and front walls 14 and 16. In each instance, the projections are offset from one another and overlapped to the extent shown to function in the manner discussed with respect to FIGS. 13 through 15 in receiving, gripping and resisting withdrawal of the display card from the holder.

The display card holder, according to this invention, therefore provides an extruded rigid plastic channel portion having opposing sidewalls with a plurality of pliable plastic projections coextruded on both of the sidewalls. Such an arrangement provides an attractive unit which can be readily made in various forms for several different uses. The unit may be formed of various coloured plastics material to enhance its display capabilities and presents a clean surface which is not subjected to rusting or corrosion. The plastic coextruded projections in the channel, as protected by the channel walls, are quite durable and may be reused many times. The flexibility of the projections are such that they will readily accommodate various thickness of display cards due to their overlapping nature.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A plastic display card holder for receiving and gripping a card for display purposes, said holder comprising interconnected spaced-apart extruded wall portions of a relatively rigid plastic, said wall portions being connected in a manner to provide an entrance therebetween for a display card, a plurality of soft flexible resilient plastic fins integral with and coextruded on each of said wall portions and extending the length of each wall portion to provide a plurality of opposing fins, said plastic fins being of a soft plasticized plastic which has a durometer rating in the range of 55 to 95, said soft plasticized plastic bonding to said rigid plastic when coextruded onto said rigid plastic, said opposing fins being offset laterally of each other relative to said entrance, said fins on each said wall portion extend into the space between the wall portions greater than one-half the distance between said wall portions whereby said opposing fins overlap one another, said fins as they extend into said space between the wall portions are directed generally away from the entrance of the holder in the direction of insertion of a display card, the arrangement being such that as a display card is inserted in the holder, the fins flex away from said entrance to receive readily such inserted display card, such flexed fins of said soft plastic frictionally engaging such inserted display card and increase the grip on such display card as it is withdrawn by virtue of the fins being flexed in a direction opposite said direction in which they normally extend, said fins in flexing in said opposite direction releasing such card being withdrawn without damaging such card.

* * * * *